US007991309B2

(12) United States Patent
Hiroi

(10) Patent No.: US 7,991,309 B2
(45) Date of Patent: Aug. 2, 2011

(54) IMAGE FORMING APPARATUS

(75) Inventor: Toshiaki Hiroi, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 337 days.

(21) Appl. No.: 12/400,544

(22) Filed: Mar. 9, 2009

(65) Prior Publication Data

US 2009/0310989 A1 Dec. 17, 2009

(30) Foreign Application Priority Data

Jun. 16, 2008 (JP) ..... 2008-156313

(51) Int. Cl.
*G03G 15/00* (2006.01)

(52) U.S. Cl. ..... 399/43; 399/44

(58) Field of Classification Search ..... 399/38, 399/43, 44, 66, 75, 76, 88, 91, 94–97
See application file for complete search history.

(56) References Cited

U.S. PATENT DOCUMENTS 4,474,455 A * 10/1984 Hirakura et al. ..... 399/128
6,219,496 B1 * 4/2001 Kojima et al. ..... 399/43
6,385,412 B1 * 5/2002 Sadakuni ..... 399/75
2003/0058328 A1 3/2003 Yokoi
2008/0112718 A1 5/2008 Akashi et al.

FOREIGN PATENT DOCUMENTS

| | | |
|---|---|---|
| JP | 5-27615 | 2/1993 |
| JP | 2000-321932 | 11/2000 |
| JP | 2001-034115 | 2/2001 |
| JP | 2003-098934 | 4/2003 |
| JP | 2007-310010 | 11/2007 |
| JP | 2008-122692 | 5/2008 |

OTHER PUBLICATIONS

Japanese Notice of Reason for Refusal issued on May 6, 2010 directed to JP-2008-156313; 4 pages.

* cited by examiner

*Primary Examiner* — Hoan Tran
(74) *Attorney, Agent, or Firm* — Morrison & Foerster LLP

(57) ABSTRACT

An image forming apparatus which is free from occurrence of image noise due to the bleed phenomenon even without providing any contact-and-separation mechanism for the transfer member includes a control device which counts stop time elapsing from a stop to a restart of the image carrier, calculates an avoidance sheet count corresponding to the stop time at a restart of the image carrier, and makes a toner image carried on only part of the image carrier that has been out of the nip against the transfer member during the stop of the image carrier until the avoidance sheet count is reached after the restart of the image carrier.

5 Claims, 8 Drawing Sheets

| STOP TIME (h) | NIP-POSITION AVOIDANCE SHEET COUNT (SHEETS) | |
|---|---|---|
| | ROLLER A | ROLLER B |
| ~ 0.1 | 0 | 1 |
| ~ 15 | 1 | 5 |
| ~ 72 | 3 | 10 |
| ~144 | 5 | 12 |
| 144 ~ | 8 | 15 |

| STOP TIME (h) | NIP-POSITION AVOIDANCE SHEET COUNT (SHEETS) | | |
|---|---|---|---|
| | INTERNAL TEMPERATURE T≦10℃ | INTERNAL TEMPERATURE 10℃<T<30℃ | INTERNAL TEMPERATURE T≧30℃ |
| ~ 0.1 | 0 | 0 | 1 |
| ~ 15 | 0 | 1 | 4 |
| ~ 72 | 1 | 3 | 10 |
| ~144 | 2 | 5 | 12 |
| 144 ~ | 3 | 8 | 15 |

*Fig. 9*

| STOP TIME (h) | NIP-POSITION AVOIDANCE SHEET COUNT (SHEETS) | | |
|---|---|---|---|
| | INTERNAL EMVIRONMENT LL | INTERNAL EMVIRONMENT NN | INTERNAL EMVIRONMENT HH |
| ~ 0.1 | 0 | 0 | 1 |
| ~ 15 | 0 | 1 | 4 |
| ~ 72 | 1 | 3 | 10 |
| ~144 | 2 | 5 | 12 |
| 144 ~ | 3 | 8 | 15 |

IMAGE FORMING APPARATUS

This application is based on application No. 2008-156313 filed in Japan, the contents of which are hereby incorporated by reference.

BACKGROUND OF THE INVENTION

The present invention relates to an image forming apparatus.

In an image forming apparatus in which a toner image is formed on an image carrier such as photoconductor or transfer belt and then transferred onto a recording sheet by electrostatic force of a transfer roller or other transfer member, a top layer of the transfer member is formed of resin foam having both elasticity for slight deformation to ensure a nip (pressure contact) against the image carrier and electrical conductivity for enough chargeability to attract the toner. Such a resin contains low molecular weight materials kept out of chemical reaction in manufacture processes as well as such additives as vulcanizers, softeners or plasticizers. Keeping the transfer member in a prolonged stop as it is nipped against the image carrier causes a bleed phenomenon that those low molecular weight materials and additives would bleed out in an oil-like state from the transfer member. The bled low molecular weight materials and additives would be deposited on the image carrier to worsen its surface characteristics, resulting in occurrence of noise in the formed image. Due to this, conventional image forming apparatuses are equipped with a contact-and-separation mechanism for keeping the transfer member separated from the image carrier during stops.

Some monochrome image forming apparatuses use a transfer member which is formed of an electronically conductive resin having carbon dispersed therein for less occurrence of the bleed, with the contact-and-separation mechanism for the transfer member omitted. However, electronically conductive resins have a defect of being nonuniform in electroconductive characteristics. For color image forming apparatuses, which are required to have expressive power for correct tonal gradation, it is desirable to use an ion conductive resin which is superior in electroconductive characteristics, and omitting the contact-and-separation mechanism for the transfer member would inevitably lead to occurrence of the bleed phenomenon.

With a view to avoiding any effects of occurrence of such a phenomenon due to the developing roller, JP2001-34115A describes an invention in which the image carrier is turned to remove deposits before the start of image formation. JP2000-321932A describes an invention in which the image carrier is turned little by little even during a stop to thereby reduce nonuniformities in surface characteristics. JP2003-98934A describes an invention in which with an image carrier and a cleaning member kept in a constant positional relation during a stop, portion of the image carrier with which the cleaning member comes into contact during a stop of the image carrier is excluded out of use in the image formation in order to avoid effects of such phenomena as described above due to the cleaning member. Further, JPH5-27615A describes an invention in which cleaning of the transfer member is stopped so as to make toner interventionally provided in the nip so that bled low molecular weight materials, additives and the like are adsorbed to the toner deposited on the transfer member, thereby reducing the effects of the bleed.

In the invention of JP2003-98934A, since part of the image carrier cannot be utilized at all for the image formation, intervals between image formations would be prolonged, giving rise to a problem of lowered image formation speed.

SUMMARY OF THE INVENTION

In view of these and other issues, an object of the present invention is to provide a high-speed image forming apparatus which is free from occurrence of image noise due to the bleed phenomenon even without providing any contact-and-separation mechanism for the transfer member.

In order to achieve the above object, according to one aspect of the present invention, there is provided an image forming apparatus which comprises: an image forming section for forming a toner image; an image carrier which is turnable while carrying the toner image formed by the image forming section; a transfer member for transferring the toner image onto a recording sheet while being normally nipped against the image carrier; a control device for, upon reception of data of an image to be formed, controlling operations of the image forming section, the image carrier and the transfer member; and a position recognition part for recognizing a turning position of the image carrier, wherein the control device counts stop time elapsing from a stop to a restart of the image carrier, calculates an avoidance sheet count corresponding to the stop time at a restart of the image carrier, and makes a toner image carried on only part of the image carrier that has been out of the nip against the transfer member during the stop of the image carrier until the avoidance sheet count is reached after the restart of the image carrier.

In this image forming apparatus, part of the image carrier that has been in nip against the transfer member during the stop of the image carrier, i.e., part of the image carrier on which substances that have been bled from the transfer member by the bleed phenomenon are deposited is excluded out of use in image formation until an avoidance sheet count is reached, so that deterioration of image quality due to the deposits can be prevented. Although the deposits are increasingly removed by image forming operations, the quantity of deposits becomes increasingly larger with increasing stop time of the image forming apparatus. Therefore, increasing the avoidance sheet count with increasing stop time makes it possible to minimize the time during which part for use of the image carrier is kept limited. Once the avoidance sheet count is over, the intervals between images may be shortened to improve the image formation speed, thus allowing the image carrier to be used uniformly so that the life can be prolonged.

The image forming apparatus as described above may further comprise a temperature sensor for detecting an internal temperature of the apparatus, wherein based on a temperature during a period from a stop to a restart of the image carrier, the control device changes a calculation criterion for the avoidance sheet count.

Additives and the like are bled from the transfer member in increasingly larger amounts with increasing internal temperature of the apparatus, i.e., atmospheric temperature of the transfer member. Therefore, taking into consideration the temperature during stops makes it possible to correctly calculate the print sheet count required for removal of deposits.

The image forming apparatus as described above may further comprise a counter for cumulatively counting a total number of images formed since introduction of a new transfer member, wherein based on a total number of images formed since introduction of a new transfer member, the control device changes the calculation criterion for the avoidance sheet count.

With a new transfer member, additives and the like are more likely to be bled. Therefore, taking into consideration the cumulated use count of the transfer member makes it possible to more correctly calculate the print sheet count required for removal of deposits.

According to the above described image forming apparatus, an avoidance sheet count that is a print count to be reached until substances bled from the transfer member and deposited on the image carrier are removed is calculated based on stop time of the image forming apparatus, and keeping the deposit-part out of image formation until the avoidance sheet count is reached. Thus, deterioration of image quality can be prevented, and after the removal of the deposits, the entirety of the image carrier is used, so that the image formation efficiency can be enhanced.

BRIEF DESCRIPTION OF THE DRAWINGS

These and other objects and features of the present invention will become apparent from the following description taken in conjunction with the preferred embodiments thereof with reference to the accompanying drawings, in which:

FIG. 9 is a look-up table to be used for calculation of the nip-position avoidance sheet count in FIG. 8.

DETAILED DESCRIPTION OF THE PREFERRED EMBODIMENTS

Figure 1:
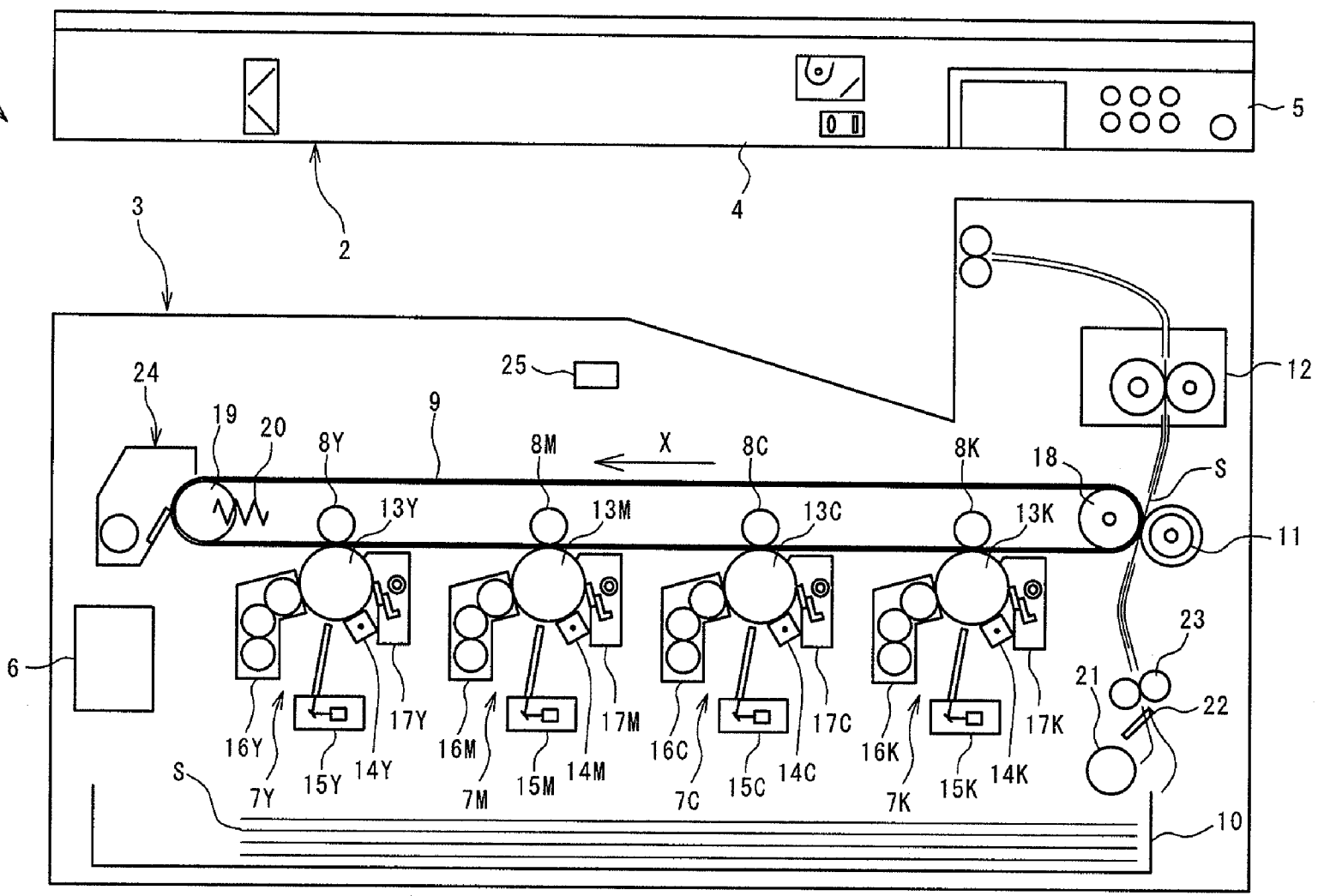
FIG. 1 is a schematic constructional view of an image forming apparatus according to a first embodiment of the present invention.

FIG. 1 shows a schematic construction of a tandem type color digital copier 1 which is one embodiment of the image forming apparatus according to the invention. The color digital copier 1 is composed of an image reader unit 2 for reading an original image, and a printer unit 3 for printing (forming) an image on a recording sheet S based on image data read by the image reader unit 2 or image data received from an unshown computer or the like connected by network.

The image reader unit 2 includes a known scanner 4 for reading an original image by CCD sensors with three-color separation into red (R), green (G) and blue (B) and further converting the image into an electric signal, and a panel section 5 which is a user interface and which has a display and operation buttons. The printer unit 3 includes a control device 6 for controlling the operation of the copier 1.

The scanner 4, on reading the original document, creates image data of R, G and B and inputs the resulting data to the control device 6. The control device 6 processes image signals to convert the signals into image data of four colors of cyan (C), magenta (M), yellow (Y) and black (K). The control device 6 also receives inputs of image signals not only from the scanner section 2 but also from an unshown computer or the like via the network.

The control device 6 reads image data of Y, M, C, K, respectively, for every one scan line to make toner images of the individual colors formed by image forming sections 7Y, 7M, 7C, 7K, and primarily transfers the resulting images to an intermediate transfer belt (image carrier) 9 by primary transfer rollers 8Y, 8M, 8C, 8K. The toner images transferred to the intermediate transfer belt 9 are secondarily transferred by a secondary transfer roller (transfer member) 11 to a recording sheet S fed from a sheet feeder unit 10, and then pressed and heated by a fixing unit 12 so as to be fixed to the recording sheet S.

The image forming sections 7Y, 7M, 7C, 7K respectively have: photoconductors 13Y, 13M, 13C, 13K; chargers 14Y, 14M, 14C, 14K for charging the photoconductors 13Y, 13M, 13C, 13K; exposers 15Y, 15M, 15C, 15K for exposing the photoconductors 13Y, 13M, 13C, 13K to light with laser light generated by a laser diode to selectively eliminate charge and thereby form electrostatic latent images; developing units 16Y, 16M, 16C, 16K for feeding toner to the electrostatic latent images formed on the photoconductors 13Y, 13M, 13C, 13K; and cleaners 17Y, 17M, 17C, 17K for removing toner remaining on the photoconductors 13Y, 13M, 13C, 13K after the primary transfer.

The intermediate transfer belt 9, stretched over between a driving roller 18 and a driven roller 19, is given tensile force by a tension spring 20 and turned along an arrow X direction. A bias voltage for giving electrostatic force with which toner images are transferred is applied to between the driving roller 18 and the secondary transfer roller 11. The color digital copier 1 includes recognition structure or members for recognizing a turning position of the intermediate transfer belt 9. The recognition structure or members may be composed of, for example, a sensor for detecting a home position of the intermediate transfer belt 9, and a calculator or circuit which calculates a turning distance of the intermediate transfer belt 9 from the home position by rotational angle or rotational time of the driving roller 18.

The recording sheet S is taken out from the sheet feeder unit 10 sheet by sheet by a sheet feed roller 21. With a leading end position of the recording sheet S detected by a sheet detection sensor 22, the recording sheet S is fed by a registration roller 23 to between the intermediate transfer belt 9 and the secondary transfer roller 11 with timing adjusted to the turn of the intermediate transfer belt 9.

The printer unit 3 further has a belt cleaner 24 for scraping off toner that has failed to be transferred to the recording sheet S by the secondary transfer roller 11 and that remains on the intermediate transfer belt 9, and an internal temperature/humidity sensor 25 for measuring temperature and humidity of the air inside the printer unit 3.

A bias voltage is applied to the primary transfer rollers 8Y, 8M, 8C, 8K to attract the toner forming the images on the photoconductors 13Y, 13M, 13C, 13K and thereby transfer the images to the intermediate transfer belt 9. Similarly, a bias voltage is applied also to the secondary transfer roller 11 to attract the toner images on the intermediate transfer belt 9 by electrostatic force and thereby transfer the images onto the recording sheet S.

The intermediate transfer belt 9, which preferably has a surface resistivity of $10^6$-$10^{12}$ Ω/□, is formed by using, for example, a resin material, such as polycarbonate, polyimide, polyethylene sulfide, polyamide imide, polyvinylidene fluoride or tetrafluoroethylene-ethylene copolymers, with carbon or other electroconductive filler dispersed therein or with an ionic conductive material contained therein. The thickness of the intermediate transfer belt 9 is preferably about 50-200 μm. Further on its surface, a coating layer of inorganic oxide or the like may also be provided.

The secondary transfer roller 11, which preferably has a surface resistivity of $10^6$-$10^{12}$ Ω/□, is formed by using, for example, a metallic core to which a medium-resistance elastic layer is attached, where the medium-resistance elastic layer is made of a resin material with carbon or other electroconductive filler dispersed in EPDM, silicon, NBR, urethane or the like or with an ionic conductive material contained therein.

Figure 2:
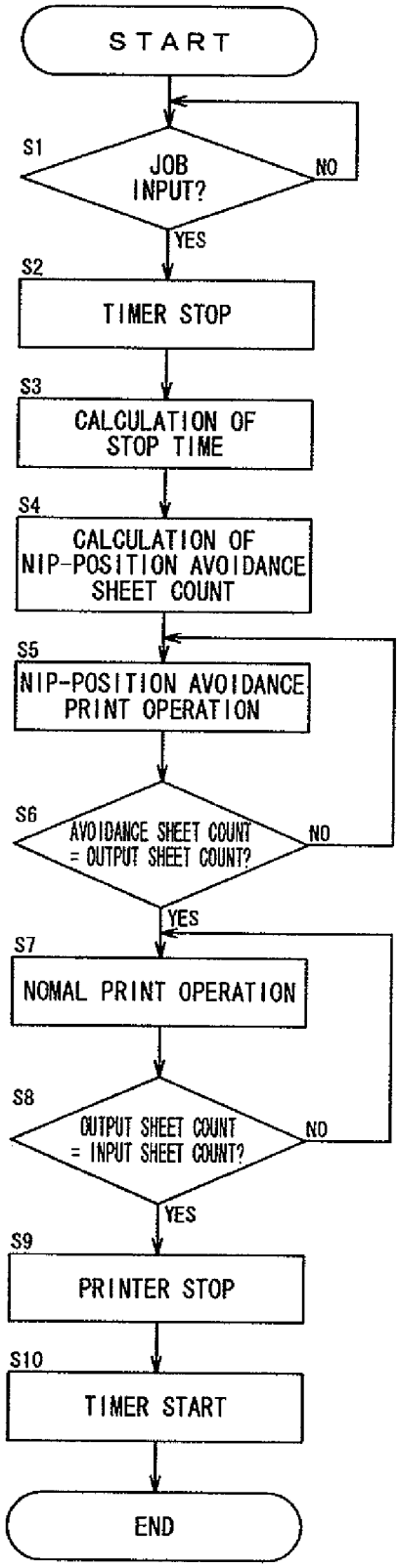
FIG. 2 is a control flowchart of the image forming apparatus according to the first embodiment of the invention.
Figures 3, 4:
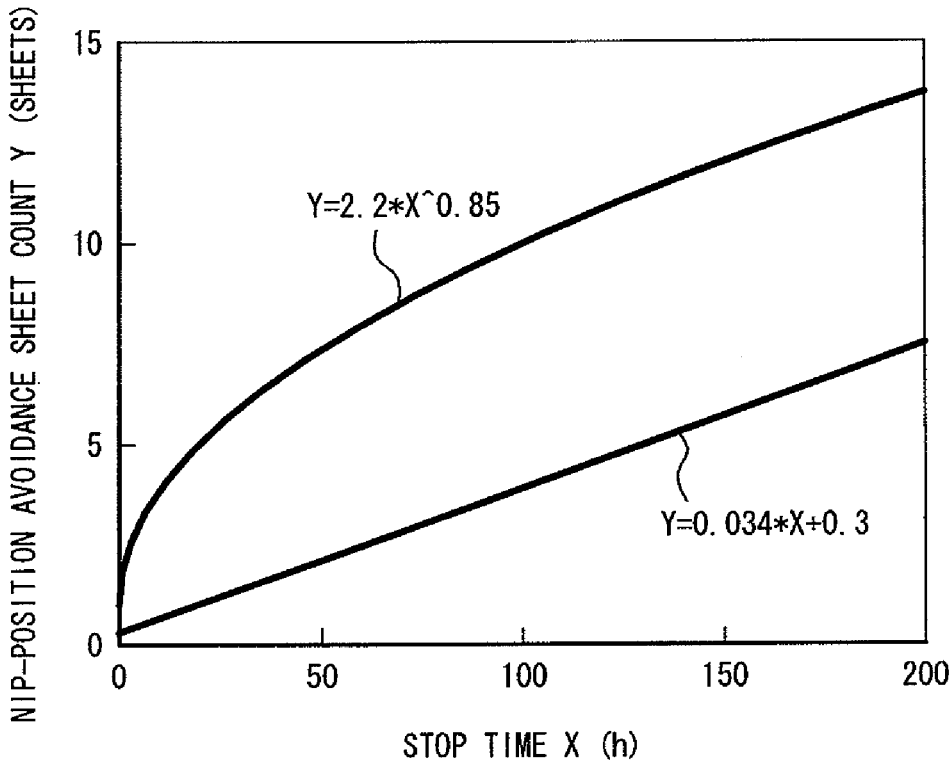
FIG. 3 is a graph showing calculational expressions of nip-position avoidance sheet count as well as their variations with time in FIG. 1.
FIG. 4 is a look-up table of an alternative to the calculational expressions of FIG. 3.

FIG. 2 shows a control flow of image formation in the color digital copier 1. When a job (image formation data) is inputted from the image reader unit 2 or an external computer or the like at step S1, the control device 6 stops a timer that has been activated upon an end of the preceding-time image formation as described later (step S2), and calculates a timer count, i.e., stop time X (h) for the printer unit 3 including the intermediate transfer belt 9 and the secondary transfer roller 11 (step S3). Then, at step S4, based on the stop time X, the control device 6 calculates a nip-position avoidance sheet count Y (pcs.) by a specified calculational expression, e.g., Y=0.034*X+0.3 as shown in FIG. 3. This avoidance sheet count Y is a number of print sheets involved until additives or other contaminants that have been bled from the secondary transfer roller 11 and deposited on the intermediate transfer belt 9 during the stop of the printer unit 3 are removed by the belt cleaner 24.

The relationship between the avoidance sheet count Y and the stop time X, which differs depending on the materials of the secondary transfer roller 11 and the intermediate transfer belt 9, the type of the belt cleaner 24 and the like, is not necessarily a linear relation expressed by a linear equation, but in some cases one expressed by such a function as Y=2.2*X^0.85 as shown in superimposition in FIG. 3.

Reverting to FIG. 2, once having calculated the avoidance sheet count Y at step S4, the control device 6, at step S5, makes toner images of the individual colors by the image forming sections 7Y, 7M, 7C, 7K, respectively, and then makes the toner images of the individual colors transferred by the primary transfer rollers 8Y, 8M, 8C, 8K in superimposition onto portions of the intermediate transfer belt 9 that have been out of the nip with the secondary transfer roller 11 during its stop, and further makes the toner image transferred from the intermediate transfer belt 9 to the recording sheet S by the secondary transfer roller 11. That is, the control device 6 functions to perform a nip-position avoidance print operation that one sheet of toner images that are designated in sequence by the job is carried only on part of the intermediate transfer belt 9 that has been out of nip with the secondary transfer roller 11 during the stop of the printer unit 3.

Once one sheet of image has been formed by the nip-position avoidance print operation, a number of images that have already been outputted in the relevant job (image formation count) and the precedently calculated nip-position avoidance sheet count are compared with each other (step S6), and images designated in the job are printed in sequence (image formation) by nip-position avoidance print operations until the output sheet count reaches the nip-position avoidance sheet count.

Subsequent to reach of the output sheet count to the nip-position avoidance sheet count, at step S7, the control device 6 makes the entire intermediate transfer belt 9 usable. Then, at step S8, inputted images are printed out in sequence until the number of sheets already printed in the job reaches an image-formation output count inputted for the job, i.e., until the job is completed. Upon an end of the job, at step S9, the image forming sections 7Y, 7M, 7C, 7K, the primary transfer rollers 8Y, 8M, 8C, 8K, the intermediate transfer belt 9 and the secondary transfer roller 11 are stopped. Then, at step S10, the timer is reset for a start. The timer continues to count suspended time of image forming operation, i.e., stop time of the intermediate transfer belt 9 until the next job is started.

As shown above, in the color digital copier 1, with the nip-position avoidance sheet count unreached, since the intermediate transfer belt 9 has additives or other contaminants deposited thereon, image formation is carried out while contaminants-deposited portion of the intermediate transfer belt 9 is avoided, so that any deterioration of the image quality is prevented. Then, the color digital copier 1, upon reach to the nip-position avoidance sheet count, decides that contaminants have been removed, and performs image forming operation with the entire intermediate transfer belt 9 used. As a result, the inter-image distance is minimized, and higher-speed image formation is achieved.

The nip-position avoidance sheet count may be calculated not only by function but also by, for example, such a look-up table stored in memory of the control device 6 as shown in FIG. 4. In this table, in the case where the type of the secondary transfer roller 11 is roller A, if the stop time X of the intermediate transfer belt 9 since the end of the preceding job is not more than 0.1 hour, then the nip-position avoidance sheet count is set to 0 pcs.; if the stop time X is more than 0.1 hour and not more than 15 hours, then the nip-position avoidance sheet count Y is set to 1 pc.; if the stop time X is more than 15 hours and not more than 72 hours, then the nip-position avoidance sheet count Y is set to 3 pcs.; if the stop time X is more than 72 hours and not more than 144 hours, then the nip-position avoidance sheet count Y is set to 5 pcs.; and if the stop time X is more than 144 hours, then the nip-position avoidance sheet count Y is set to 8 pcs.

Determining the nip-position avoidance sheet count by using such a look-up table allows the operation load of the processing device 6 to be reduced.

Figure 5:
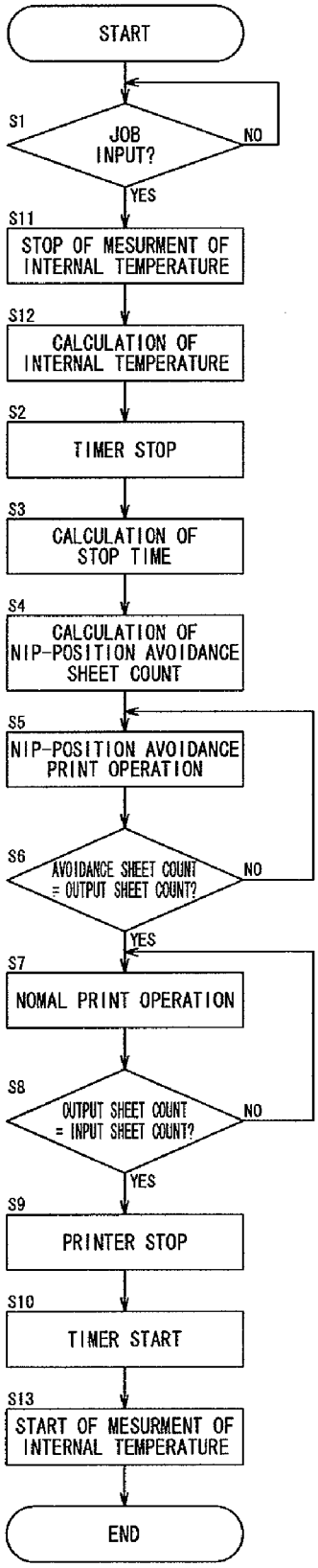
FIG. 5 is a control flowchart of an image forming apparatus according to a second embodiment of the invention.

FIG. 5 shows a control flow of an image forming apparatus according to a second embodiment of the invention. This embodiment, although embodied also in a color digital copier 1 (FIG. 1) similar in construction to that of the first embodiment, yet is characterized by calculating the avoidance sheet count in consideration of measured values of the internal temperature/humidity sensor 25. In FIG. 5, the same control steps as in the first embodiment shown in FIG. 2 are designated by the same step numbers.

In this embodiment, after input of a job at step S1, the control device 6, at step S11, first stops measurement of internal temperature of the color digital copier 1 by the internal temperature/humidity sensor 25, and then at step S12, calculates an average internal temperature T (° C.) of the color digital copier 1 over a period from the preceding job to the current job. Thereafter, calculation of the stop time X of the intermediate transfer belt 9 at step S3 as well as computation of the nip-position avoidance sheet count Y at step S4 are carried out as in the first embodiment, but the calculational expression to be used differs depending on the value of the average temperature T during stops.

For example, if the average temperature T during a stop is not more than 10° C., then a calculational expression that Y=0.014*X is used; if the average temperature T during a stop is more than 10° C. and less than 30° C., then a calculational expression that Y=0.034*X+0.3 is used; and if the average temperature T during a stop is more than 30° C., then a calculational expression that Y=2.1*X^0.34 is used.

In this embodiment, control operation similar to that of the first embodiment is exerted except for the calculation of the nip-position avoidance sheet count shown above. Then, after the stop of the printer unit 3 (step S9) and the start of the timer (step S10), measurement of internal temperature by the internal temperature/humidity sensor 25 is started at step S13.

Figures 6, 7:
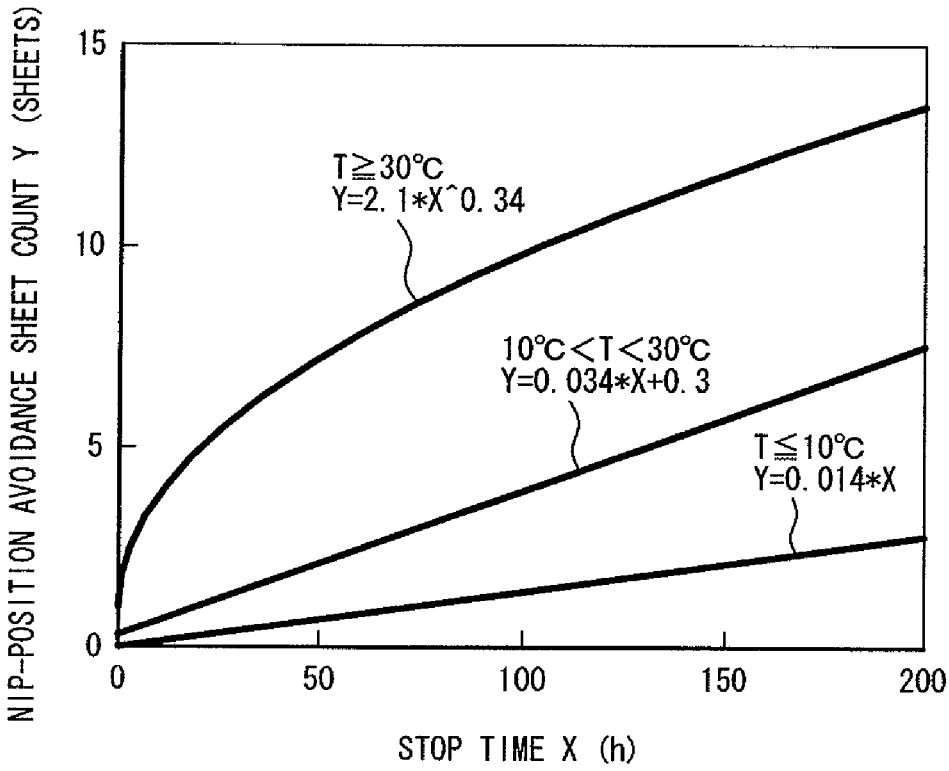
FIG. 6 is a graph showing calculational expressions of nip-position avoidance sheet count as well as their variations with time in FIG. 5.
FIG. 7 is a look-up table of an alternative to the calculational expressions of FIG. 6.

As shown above, in this embodiment, the calculational expression serving as a calculation criterion for the avoidance sheet count is changed so that, as shown in FIG. 6, the avoidance sheet count is increased for higher temperatures during a stop, while the avoidance sheet count is decreased for lower temperatures. The bleed phenomenon that additives and the like bleed from the secondary transfer roller 11 increases with increasingly higher temperatures, and decreases with increasingly lower temperatures. Accordingly, changing the calculational expression as in this embodiment makes it possible to calculate the nip-position avoidance sheet count to be calculated with less margin.

In this embodiment also, instead of the calculational expression, such a look-up table as shown in FIG. 7 may be used to determine the nip-position avoidance sheet count.

Figure 8:
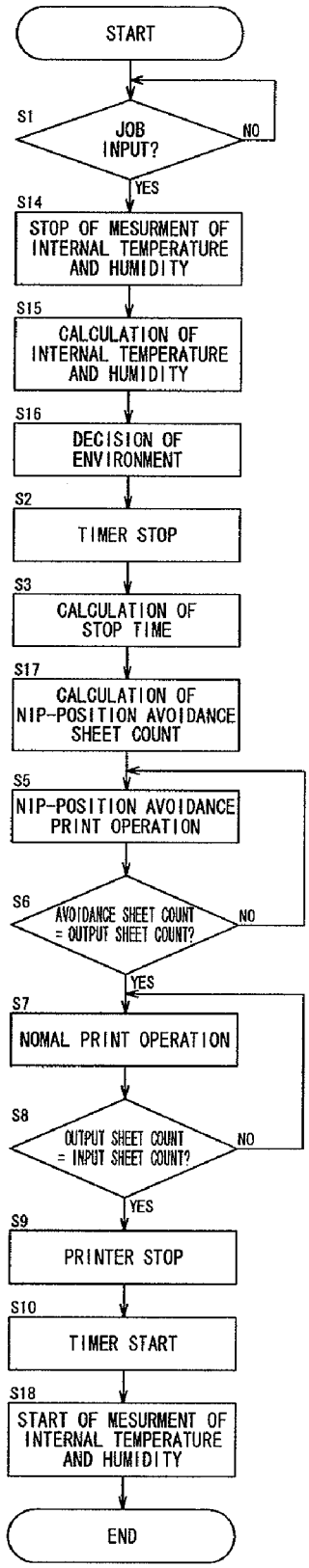
FIG. 8 is a control flowchart of an image forming apparatus according to a third embodiment of the invention.

FIG. 8 shows a control flow of an image forming apparatus according to a third embodiment of the invention. This embodiment, although embodied also in a color digital copier 1 (FIG. 1) similar in construction to that of the first embodiment, yet is characterized by determining the avoidance sheet count in consideration of temperature and humidity values measured by the internal temperature/humidity sensor 25 as well. In this embodiment also, the same control steps as in the first embodiment are exerted except for the calculation of the nip-position avoidance sheet count Y, and so the same control steps as in the first embodiment are designated by the same step numbers.

In this embodiment, after a stop of measurement of internal temperature and humidity by the internal temperature/humidity sensor 25 (step S14), at step S15, an average humidity H(%) as well as an average temperature T(° C.) in the color digital copier 1 during a period from a preceding job to a current job are calculated from measured values by the internal temperature/humidity sensor 25. Then, based on the average temperature T and the average humidity H, an internal environment of the apparatus during a stop of the intermediate transfer belt 9 is classified into three categories which consist of HH, i.e. high temperature and high humidity ($T \geqq 30°$ C. or $H \geqq 85\%$), NN, i.e. normal temperature and humidity ($10° C. < T < 30°$ C. and $15\% < H < 85\%$), and LL, i.e. low temperature and low humidity ($T \leqq 10°$ C. or $H \leqq 15\%$) (step S16). Then, with use of calculational expressions differing among the individual cases or such a look-up table as exemplified in FIG. 9, a nip-position avoidance sheet count Y corresponding to the stop time X is determined (step S17). Then, nip-position avoidance print operations corresponding to the nip-position avoidance sheet count Y and normal print operations corresponding to the remaining print sheet count are executed. Upon an end of the job, measurement by the internal temperature/humidity sensor 25 is started at step S18.

Figure 10:
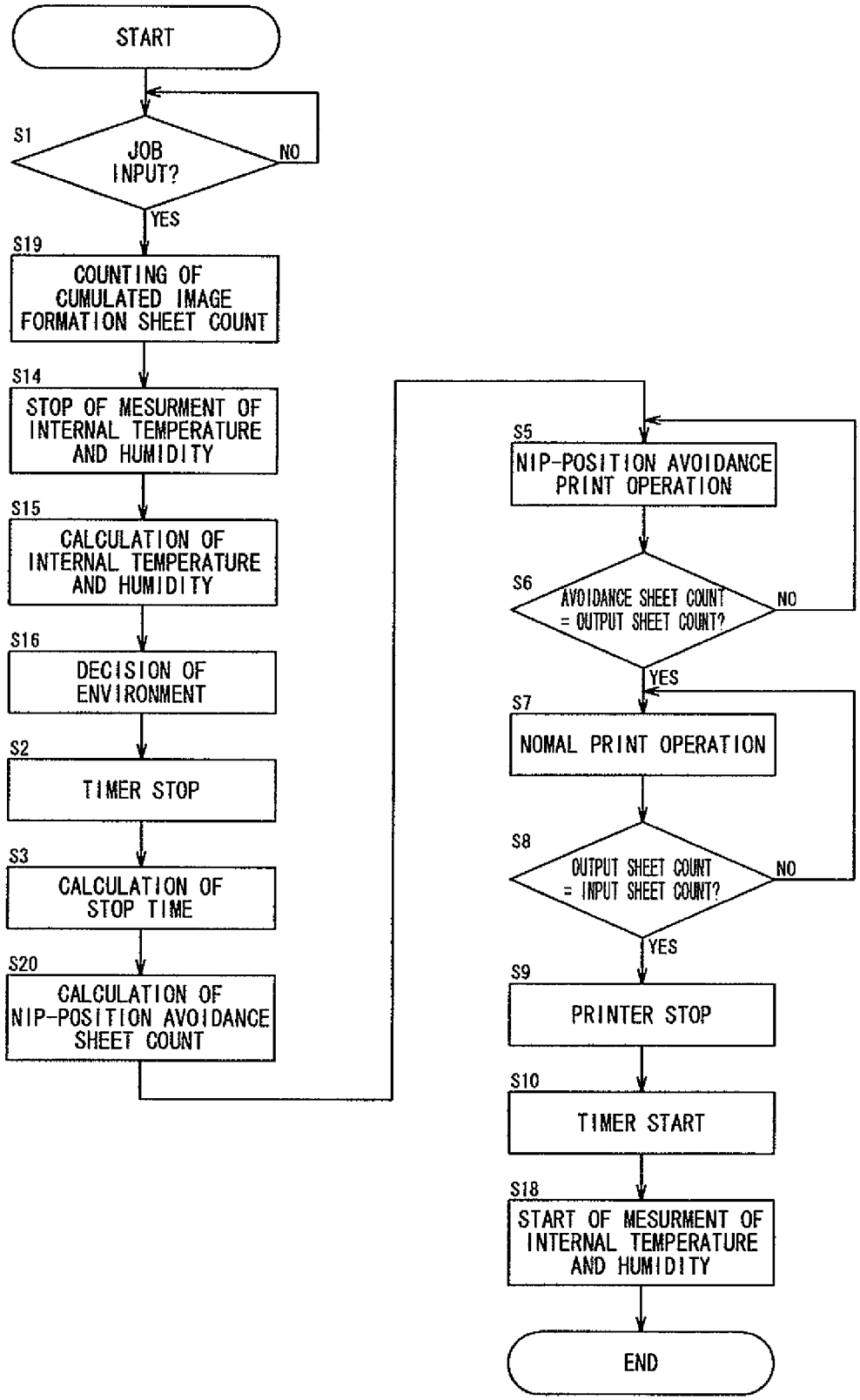
FIG. 10 is a control flowchart of an image forming apparatus according to a fourth embodiment of the invention.

FIG. 10 shows a control flow of an image forming apparatus according to a fourth embodiment of the invention. In this embodiment, a cumulated value Z of image formation sheet count, as counted from a new introduction of the secondary transfer roller 11, is counted at step S19. Then, as in the third embodiment, the internal environment of the apparatus during a stop of the intermediate transfer belt 9 is classified into categories depending on measured values of the internal temperature/humidity sensor 25.

Further, in this embodiment, at step S20, the calculation criterion for the nip-position avoidance sheet count Y is changed depending on the cumulated image formation sheet count Z to determine a nip-position avoidance sheet count Y. For example, a calculational expression in which the nip-position avoidance sheet count Y is represented by a function of the stop time X and the cumulated image formation sheet count Z and which differs depending on the internal environment may be used; otherwise, categories of the internal environment may be further subcategorized depending on the value of the cumulated image formation sheet count Z, and calculational expressions dependent on X alone may be assigned to those subcategories, respectively.

Moreover, in this embodiment also, the nip-position avoidance sheet count Y may be determined by a look-up table (e.g., three-dimensional one) instead of calculational expressions.

Although the present invention has been fully described in connection with the preferred embodiment thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. An image forming apparatus, comprising:

an image forming section for forming a toner image;

an image carrier which is turnable while carrying the toner image formed by the image forming section;

a transfer member for transferring the toner image onto a recording sheet while being normally nipped against the image carrier;

a control device for, upon reception of data of an image to be formed, controlling operations of the image forming section, the image carrier and the transfer member; and a position recognition part for recognizing a turning position of the image carrier, wherein the control device counts stop time elapsing from a stop to a restart of the image carrier, calculates an avoidance sheet count corresponding to the stop time at a restart of the image carrier, and makes a toner image carried on only part of the image carrier that has been out of the nip against the transfer member during the stop of the image carrier until the avoidance sheet count is reached after the restart of the image carrier.

2. The image forming apparatus as claimed in claim 1, further comprising an environment sensor for detecting an internal environment of the apparatus, wherein based on an environment during a period from a stop to a restart of the image carrier, the control device changes a calculation criterion for the avoidance sheet count.

3. The image forming apparatus as claimed in claim 2, wherein the environment sensor detects an internal temperature of the apparatus.

4. The image forming apparatus as claimed in claim 2, wherein the environment sensor detects an internal humidity of the apparatus.

5. The image forming apparatus as claimed in claim 1, further comprising a counter for cumulatively counting a total number of images formed since introduction of a new transfer member, wherein based on a total number of images formed since introduction of a new transfer member, the control device changes the calculation criterion for the avoidance sheet count.

* * * * *